US005816041A

United States Patent [19]

Greninger

[11] Patent Number: 5,816,041

[45] Date of Patent: Oct. 6, 1998

[54] PREMIX FUEL NOZZLE

[75] Inventor: Allewis A. Greninger, Allegany, N.Y.

[73] Assignee: Dresser Industries, Inc., Dallas, Tex.

[21] Appl. No.: 847,692

[22] Filed: Apr. 28, 1997

Related U.S. Application Data

[62] Division of Ser. No. 454,833, May 31, 1995, Pat. No. 5,669,218.

[51] Int. Cl.[6] ..... F02C 3/30

[52] U.S. Cl. ..... 60/39.05; 60/39.06

[58] Field of Search ..... 60/737, 738, 740, 60/39.465, 39.49, 39.36, 35.55, 39.05, 39.06; 239/310, 318

[56] References Cited

U.S. PATENT DOCUMENTS

| | | |
|---|---|---|
| 3,728,859 | 4/1973 | Seiler . |
| 3,826,080 | 7/1974 | DeCorso et al. . |
| 3,859,787 | 1/1975 | Anderson et al. . |
| 3,937,007 | 2/1976 | Kappler . |
| 4,012,904 | 3/1977 | Nogle . |
| 4,041,699 | 8/1977 | Schelp . |
| 4,067,190 | 1/1978 | Hamm . |
| 4,195,476 | 4/1980 | Wood . |
| 4,257,235 | 3/1981 | Morishita . |
| 4,835,476 | 5/1989 | Rutter . |
| 5,081,843 | 1/1992 | Ishabashi . |
| 5,086,979 | 2/1992 | Koblish . |
| 5,117,636 | 6/1992 | Bechtel, II et al. . |
| 5,199,265 | 4/1993 | Borkowicz . |
| 5,235,814 | 8/1993 | Leonard . |
| 5,251,447 | 10/1993 | Joshi et al. . |
| 5,477,671 | 12/1995 | Mowill . |

*Primary Examiner*—Michael Koczo
*Attorney, Agent, or Firm*—Haynes and Boone, L.L.P.

[57] ABSTRACT

Air and gaseous fuel for a gas turbine combustor are mixed within a nozzle prior to being introduced into the combustor. The fuel is introduced into an upstream end of an elongated passageway through the nozzle, while air entry ports are located in the throat of a venturi section at an intermediate portion of the elongated passageway. Each of the air passageways leading to the air entry ports is inclined at an acute angle to the longitudinal axis of the elongated passageway so that the direction of flow of air through the respective air passageway into the venturi section and the direction of fuel flow through the elongated passageway are both towards the downstream section of the elongated passageway. The venturi section allows mixing of low pressure air and high pressure gaseous fuel without excessive fuel pressure loss. Water can be injected into a mixing chamber downstream of the venturi section and upstream of nozzle outlet ports. The resulting gaseous fuel/air/water mixture is ejected into a combustion chamber through a plurality of nozzle outlet ports. Additional combustion air is introduced into the combustion chamber via inlets in the combustion chamber wall. The combustion chamber can be an annular chamber with a plurality of the nozzle structures spaced apart from each other about the outer circumference of the annular chamber.

6 Claims, 3 Drawing Sheets

PREMIX FUEL NOZZLE

RELATED APPLICATION

This is a division of application Ser. No. 08/454,833, filed on May 31, 1995, now U.S. Pat. No. 5,669,218.

FIELD OF THE INVENTION

The invention relates to a method for operating a gas turbine engine and to a combustion apparatus for use in such method. In particular, a nozzle structure is provided for premixing air, fuel and, optionally, water prior to the resulting mixture entering the combustion chamber of the gas turbine engine.

BACKGROUND OF THE INVENTION

One of the characteristics of many gas turbine engine combustors is the creation of nitrogen oxides. Various efforts have been made to design and operate gas turbine engine combustors so as to minimize the production of nitrogen oxides.

The production of nitrogen oxides increases with an increase in the combustion temperature. The combustion temperature varies with the fuel to air equivalence ratio, with a peak combustion temperature occurring at a fuel/air equivalence ratio of approximately 1:1. Thus, one technique has been to run the gas turbine engine combustors at a fuel to air equivalence ratio which is leaner than the ratio producing the peak value, so as to reduce the combustion temperature, and thus reduce the production of nitrogen oxides. However, as it is generally desirable that the gas turbine engine operates over a large range of the fuel/air equivalence ratio, it is difficult to maintain the fuel/air equivalence ratio at the desired low values. Moreover, igniting the fuel/air mixture and maintaining combustion becomes more difficult at lower fuel/air equivalence ratios. While the ignition can be improved by increasing the temperature of the air and/or fuel prior to combustion, this would result in an increased combustion temperature. While the combustion temperature is lower at fuel/air equivalence ratios greater than the stoichiometric value, this does not provide efficient utilization of the fuel, and flooding of the combustion chamber can occur at high fuel/air equivalence ratios.

Another technique has been to add water to the combustor at a water/fuel weight ratio of 1:1 to thereby lower the combustion temperature and thus reduce the production of nitrogen oxides. However, the injection of water into the combustor is detrimental to the service life of the combustor. Moreover, if the water is injected directly into the combustion chamber without premixing with the air and fuel, it is difficult to achieve satisfactory combustion because of the nonuniformity of the distribution of the components in the combustion chamber. On the other hand, premixing for maximum uniformity can result in premature combustion.

Another problem encountered with some gas turbine engine combustors is the low pressure of the available combustion air. For example, Koblish et al, U.S. Pat. No. 5,086,979, seeks to overcome this problem by utilizing a small airblast fuel nozzle which provides inner air inlet passages of higher efficiency by maximizing the value of the distance between the centerline of air inlet passages and the centerline of the inner air swirl chamber. However, such nozzles maintain the fuel and air separate from each other to the last possible moment, at which time the air blasts the fuel out of the nozzle. Thus, mixing occurs only at and downstream of the nozzle exit.

SUMMARY OF THE INVENTION

In accordance with the present invention, high pressure fuel and low pressure air are premixed, without excessive fuel pressure loss, in a nozzle structure before being introduced into the combustor envelope, with the resulting mixture having a fuel/air equivalence ratio which is too rich for the mixture to ignite in the nozzle. The nozzle structure has an elongated passageway comprising an upstream section, a venturi section, and a downstream section. The upstream section is provided with a fuel inlet to pass fuel sequentially through the upstream section, the venturi section, and the downstream section of the elongated passageway; while the downstream section is provided with at least one nozzle outlet connecting the downstream section to the combustion chamber. The nozzle structure has at least one air inlet passageway extending from an exterior surface to the venturi throat, whereby passage of fuel through the venturi section educts air through the at least one air inlet passageway into the venturi section so that the thus educted air mixes with the fuel passing through the venturi section. Each air inlet passageway is inclined at an acute angle to the longitudinal axis of the elongated passageway such that the direction of flow of air through the respective air inlet passageway into the venturi section and the direction of flow of fuel through the elongated passageway are both towards the downstream section of the elongated passageway.

In one embodiment of the invention, water is introduced into the downstream section of the elongated passageway for mixing with the mixture of fuel and air passing through the downstream section.

The combustion chamber can be in the form of an annular chamber with a plurality of the nozzle structures extending into the annular chamber at a plurality of locations spaced apart from each other about the outer circumference of the annular chamber, while the combustion chamber is positioned within an annular casing to form an annular air passageway. The nozzle structures are positioned so that the air inlet passageways are within the annular air passageway.

In a presently preferred embodiment of the invention, the fuel/air equivalence ratio of the mixture of fuel and air passing through the downstream section of the elongated passageway is substantially greater than 1, while additional air is introduced directly into the combustion chamber so that the resulting fuel/air equivalence ratio in the first section of the combustion chamber is substantially less than 1. Water can be injected into the nozzle structure such that the weight ratio of water to fuel passing through the downstream section of the nozzle structure is less than about 0.8.

DETAILED DESCRIPTION

Figure 1:
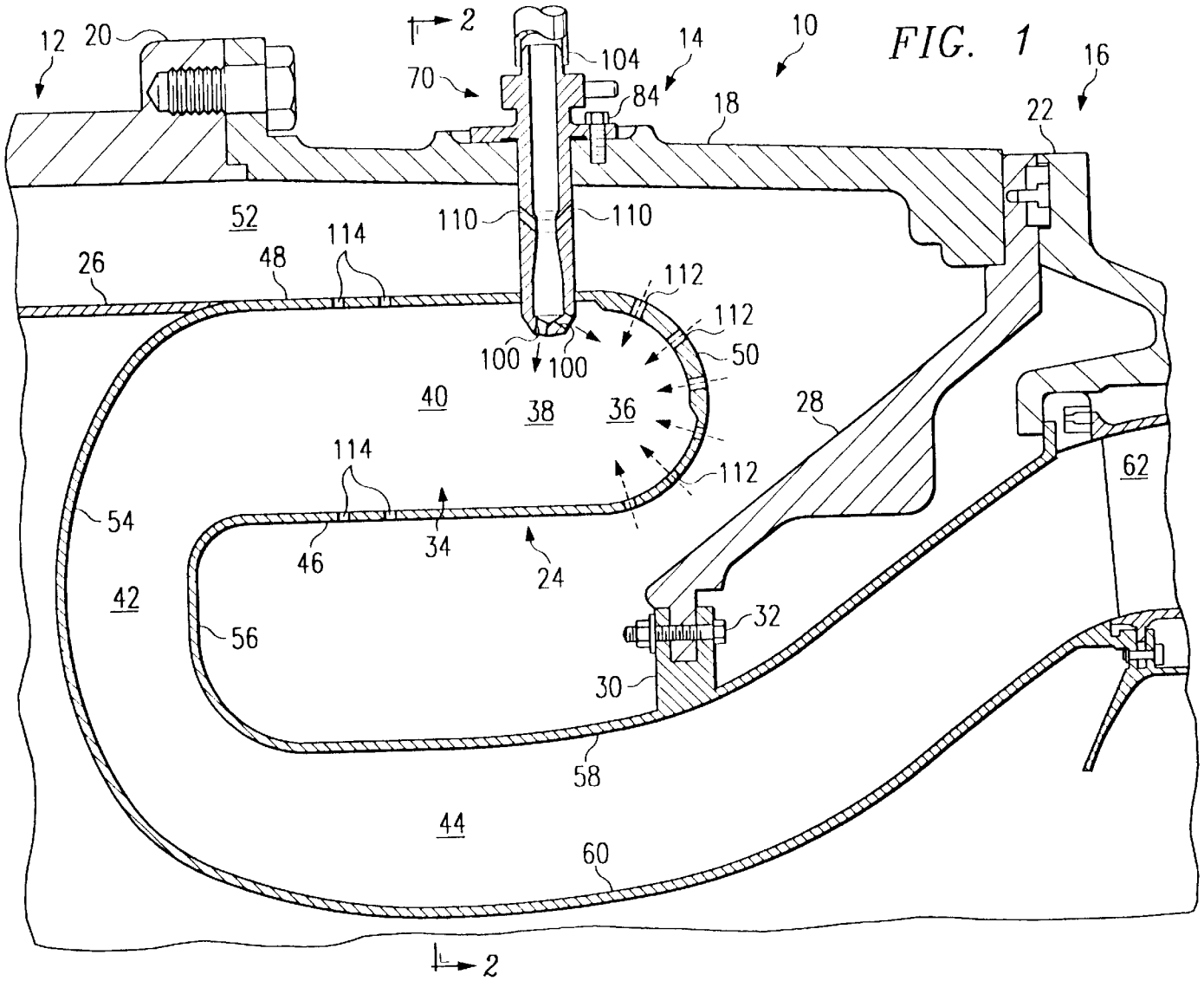
FIG. 1 is a partial view, in longitudinal cross-section, of a portion of the combustor zone of a gas turbine engine, incorporating a fuel/air premix nozzle in accordance with the present invention.

Referring now to FIG. 1, the gas turbine engine 10 comprises an air compressor section 12, a combustion section 14, and a turbine section 16. The combustion section 14 comprises an annular combustion section casing 18 having an upstream end connected to the annular casing 20 of the air compressor section 12 and a downstream end connected to the annular casing 22 of the turbine section 16. An annular combustion chamber structure 24 is mounted within the annular combustion section casing 18 by a longitudinally extending first annular support 26 and a generally radially extending second annular support 28. The upstream end of the first annular support 26 is secured to part of the structure of the air compressor section 12. The outer circumference of the second annular support 28 is secured to the downstream end of the combustion section casing 18 and the upstream end of the turbine section 16, while the inner circumference of the second annular support 28 is secured to an annular flange 30 in the combustion chamber structure 24 by a plurality of bolts 32.

The combustion chamber structure 24 forms a combustion chamber 34 containing an inlet end portion 36, a fuel injection portion 38, a downstream air injection portion 40, a radially inwardly directed portion 42, and an outlet end portion 44. The fuel injection portion 38 and the downstream air injection portion 40 constitute an intermediate portion of the combustion chamber 34. The portion of the combustion chamber structure 24 which forms the inlet end portion 36, the fuel injection portion 38, and the downstream air injection portion 40 comprises the annular inner wall 46, the annular outer wall 48, and the annular end wall 50. The annular outer wall 48 is spaced concentrically to and outwardly from the annular inner wall 46 to define the intermediate annular portion 38 and 40 of the combustion chamber 34 therebetween, while the annular end wall 50 connects an end of the annular inner wall 46 and an end of the annular outer wall 48 to collectively define the inlet end portion 36 of the combustion chamber 34. The annular end wall 50 is sometimes referred to as the dome of the combustion chamber 34. The annular outer wall 48 is positioned concentric to and spaced inwardly from the annular combustion section casing 18 to form the annular air passageway 52 therebetween.

The radially inwardly directed portion 42 of the combustion chamber 34 is formed by first and second generally U-shaped annular walls 54 and 56, with the first annular wall 54 being a continuation of the annular outer wall 48 and the second annular wall 56 being a continuation of the annular inner wall 46. The outlet end portion 44 of the combustion chamber 34 is formed by the longitudinally extending outer annular wall 58 and the longitudinally extending inner annular wall 60, with the outer annular wall 58 being a continuation of the annular wall 56 and the inner annular wall 60 being a continuation of the annular wall 54. Thus, the combustion chamber 34 is in the form of an annular hollow structure having a U-shape in a cross-section radial to the longitudinal axis of the gas turbine engine 10 with the opening between the legs of the U facing the turbine section 16, the end of the outer leg of the U being closed by the dome end wall 50 and the end of the inner leg of the U being connected to the annular inlet 62 of the turbine section 16 for transfer of the combustion products from the combustion chamber 34 to the turbine.

Figure 2:
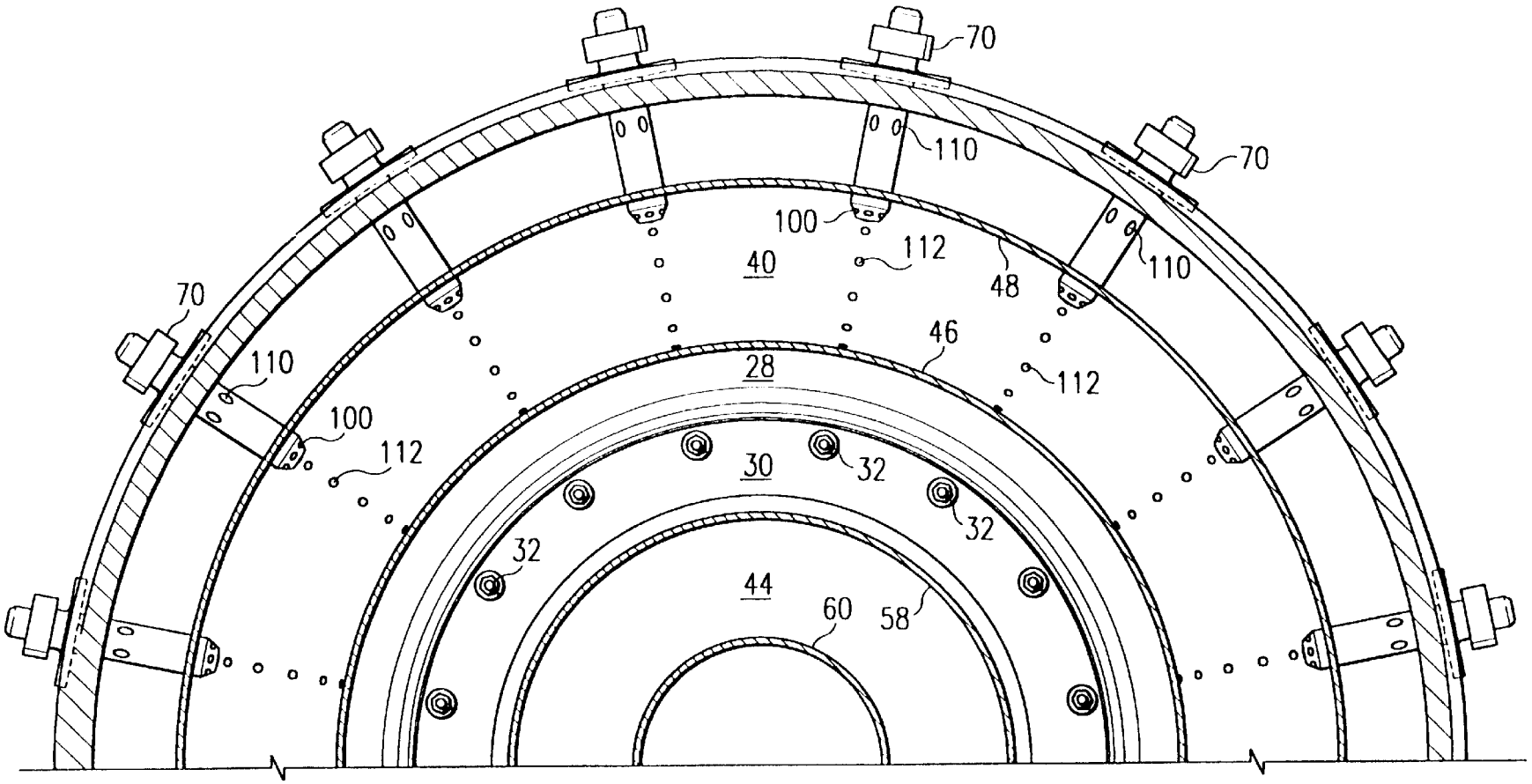
FIG. 2 is a partial cross-sectional view taken along line 2—2 in FIG. 1.

A plurality of nozzle structures 70 are mounted to the exterior of the annular combustion section casing 18 such that each nozzle structure 70 extends through the annular combustion section casing 18, through the annular air passageway 52, through the annular outer wall 48, and into the fuel injection portion 38 of the combustion chamber 34. The nozzle structures 70 are positioned at a plurality of locations spaced apart from each other about the circumference of the annular outer wall 48. As illustrated in FIG. 2, the nozzle structures 70 are positioned at equal angular spacing about the longitudinal axis of the gas turbine engine 10 in a plane perpendicular to the longitudinal axis of the gas turbine engine 10, with the longitudinal axis of each nozzle structure 70 being at least substantially radial to the longitudinal axis of the gas turbine engine 10.

Figure 3:
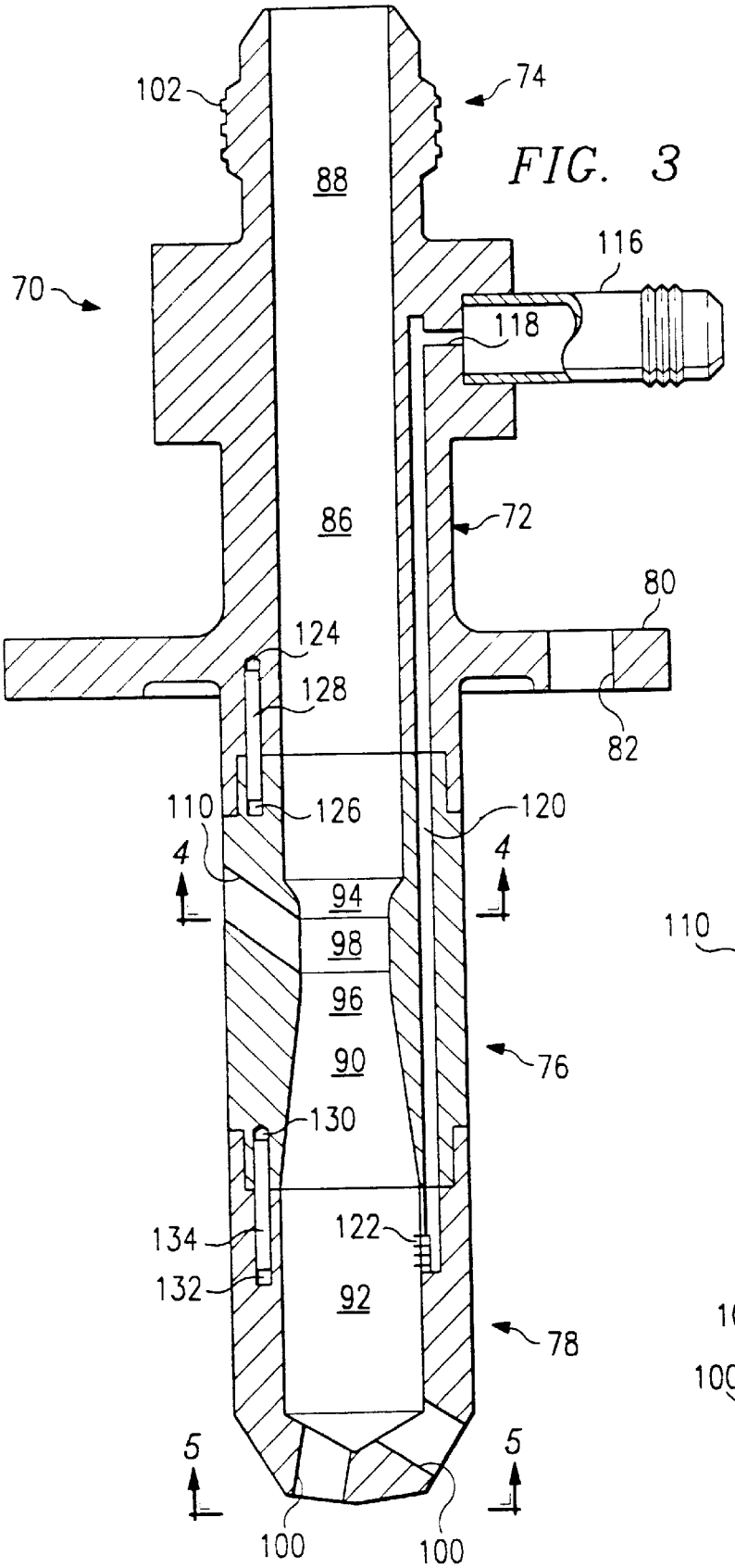
FIG. 3 is a longitudinal cross-sectional view of the fuel/air premix nozzle of FIG. 1, with the right and left sides of the figure being in different planes containing the longitudinal axis of the nozzle.
Figure 4:
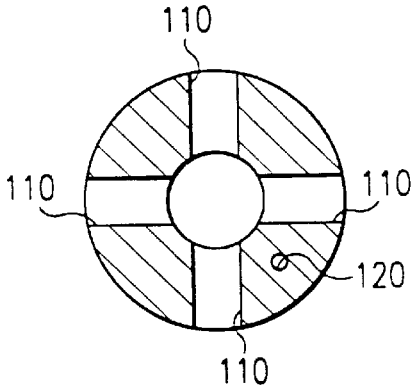
FIG. 4 is a cross-sectional view taken along line 4—4 in FIG. 3.
Figure 5:
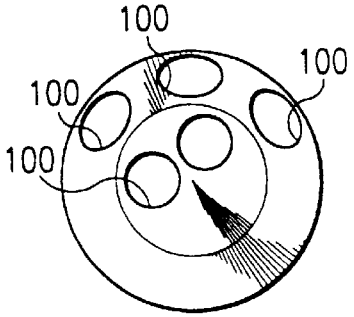
FIG. 5 is a view of the outlet end of the fuel/air premix nozzle of FIG. 3.

Referring to FIGS. 3–5, each of the nozzle structures 70 comprises an elongated, generally cylindrical housing 72 having a first end portion 74, an intermediate portion 76, and a second end portion 78. The downstream end portion of the first end portion 74 is provided with a radially extending flange 80, containing a plurality of bolt holes 82, for securing the nozzle structure 70 to the combustion section casing 18 by means of bolts 84 (FIG. 1). The housing 72 forms an elongated passageway 86 extending from the first end portion 74 to the second end portion 76. The elongated passageway 86 comprises an upstream section in the form of a cylindrical chamber 88, a venturi section 90, and a downstream section in the form of a cylindrical chamber 92. The venturi section 90 comprises an inwardly converging generally frustoconical inlet portion 94, an outwardly converging outlet portion 96, and a throat 98 connecting the inlet portion 94 to the outlet portion 96. The throat 98 has an internal diameter which is smaller than the internal diameter of the upstream section 88 as well as the internal diameter of the downstream section 92.

The downstream end of housing 74 is closed except for the presence of at least one nozzle outlet port 100 connecting the downstream section 92 of the elongated passageway 86 to the combustion chamber 34. The nozzle outlet ports 100 are located in the part of the second end portion 78 of housing 72 which is exposed to the interior of combustion chamber 34. The total cross-sectional area of the nozzle outlet ports 100 is less than the cross-sectional area of cylindrical chamber 92, such that the nozzle outlet ports 100 serve to restrict the flow of fluid from the nozzle structure 70. As shown in FIG. 5, each nozzle structure 70 of the illustrated embodiment of the invention is provided with five nozzle outlet ports 100, with two nozzle outlet ports having a small angle of inclination to the longitudinal axis of the nozzle structure, e.g. 10°, and three nozzle outlet ports having a larger angle of inclination to the longitudinal axis of the nozzle structure 70, e.g. 57.5°, and with all of the nozzle outlet ports 100 being located within a 180° arc with respect to the longitudinal axis of the nozzle structure 70 such that the jets exiting the nozzle outlet ports 100 are directed toward the dome 50.

The upstream section 88 has an inlet opening in the upstream end of the first end portion 74 of the housing 72, and the first end portion 74 is provided with external threads 102 for engagement with internal threads on the outlet end of conduit 104 (FIG. 1) such that conduit 104 is in fluid communication with chamber 88. The conduit 104 is connected to a fuel manifold (not shown) in order to pass fuel sequentially through the conduit 104, the upstream chamber 88, the venturi section 94, the downstream chamber 92, and the nozzle outlet ports 100 into the combustion chamber 34. As illustrated in FIG. 1, the flange 80 is positioned on the exterior surface of the combustion section casing 18 so that the conduit 104 is connected to the first end portion of the nozzle structure 70 exteriorly of the annular combustion section casing 18.

Each nozzle structure 70 has at least one air inlet passageway 110 extending from the venturi throat 98 to an exterior surface of a portion of the nozzle structure 70 which is exposed to air in the annular air passageway 52, whereby the passage of fuel through the venturi section 90 educts air from the annular air passageway 52 into and through the at least one air inlet passageway 110 into the throat 98 of the venturi section 90 so that the thus educted air mixes with the fuel passing through the venturi section 90. As shown in FIG. 4, each nozzle structure 70 in the illustrated embodiment of the invention has four air inlet passageways 110 spaced apart at approximately 90° intervals about the longitudinal axis of the nozzle structure 70. Each of the air inlet passageways 110 is inclined at an acute angle to the longitudinal axis of the elongated passageway 86, e.g. 50°, such that the direction of flow of air through the respective air inlet passageway 110 into the venturi section 90 and the direction of flow of fuel through the elongated passageway 86 are both towards the downstream section 92 of the elongated passageway 86.

Thus, air from air inlet passageways 110 and fuel from conduit 104 are brought together in the venturi section 90 and then introduced into chamber 92. As the nozzle outlet ports 100 restrict the flow of fluid from the chamber 92, a thorough mixing of the air and fuel occurs in the chamber 92 within the nozzle structure 70 prior to the resulting mixture exiting the nozzle outlet ports 100 into the combustion chamber 34. The fuel/air equivalence ratio for the mixed fluid exiting chamber 92 should be greater than 2.75, and preferably is at least 3. As illustrated in FIG. 1, additional combustion air is introduced into combustion chamber 34 from annular air passageway 52 by way of a plurality of air inlet openings 112 in the dome 50. The mixture of air and fuel exiting the nozzle structures 70 is directed counter to the inflow of air through air inlet openings 112, thereby providing mixing of the fresh air with the air/fuel mixture from the nozzle structures 70. If desired, the air inlet openings 112 can be inclined so as to introduce the additional air into the combustion chamber 34 in the form of one or more swirls, thereby enhancing mixing. The fuel/air equivalence ratio for the mixture of fresh air from openings 112 and the fluid from nozzle structures 70 should be in the range of about 0.55 to about 0.7, and is preferably about 0.64.

The combustion chamber walls 46 and 48 can be provided with at least one air inlet opening 114 between the air passageway 52 and the intermediate portion 40 of the combustion chamber 34 downstream of the nozzle structures 70 to introduce additional combustion air into the combustion chamber 34.

Referring again to FIG. 3, if desired, a stream of water can be injected into the mixing chamber 92 downstream of the venturi section 90 and upstream of the nozzle outlet ports 100 in order to aid in lowering the combustion temperature in combustion chamber 34. This can be accomplished by connecting conduit 116 between a source of water (not shown) and a radially extending water inlet passageway 118 located in the first end portion 74 of the housing 72 of the nozzle structure 70. At least one water passageway 120 can be provided in the body of housing 72 extending at least generally parallel to the longitudinal axis of housing 72 from the water inlet passageway 118 to a plurality of injection ports 122 located in the inner wall of chamber 92 upstream of the nozzle outlet ports 100, such that water jets are directed at least generally radially into the fluid mixture passing through chamber 92. The resulting mixture of fuel/air/water is ejected into the combustion chamber 34 through the nozzle outlet ports 100 located in the distal end of the nozzle structure 70. The weight ratio of water to fuel passing through chamber 92 should be less than 1.0, and preferably less than 0.5.

The invention is particularly applicable to a gas turbine combustion engine utilizing gaseous fuel having a higher pressure than the pressure of the air in the air passageway 52. The gaseous fuel is introduced into the nozzle structure 70 at the upstream end of the first end of the nozzle structure 70, while the air entry ports 110 into the nozzle structure 70 are located in the throat 98 of the venturi section 90 through which the gaseous fuel passes. Although the pressure of the air at the air entry ports 110 is less than the pressure of the gaseous fuel upstream of the venturi section 90, the passage of the gaseous fuel through the venturi section 90 educts the air from the air entry ports 110 into the venturi section and achieves mixing of the air and gaseous fuel without excessive loss of gaseous fuel pressure. In one embodiment of the invention, the fuel/air equivalence ratio of the resulting mixture of fuel and air passing through the mixing chamber 92 is substantially greater than 1, such that the mixture is too rich to combust within the nozzle structure 70. However, sufficient additional air is provided directly to the first section of the combustion chamber 34 via the air inlet openings 112 for mixing with the mixture of fuel and air entering the first section of the combustion chamber 34 from the nozzle structure 70 such that the resulting fuel/air equivalence ratio in the first section of the combustion chamber 34 is substantially less than 1. Water can be introduced into the mixing chamber 92 for mixing with the mixture of fuel and air passing through the mixing chamber 92 such that the weight ratio of water to fuel passing through the mixing chamber section is less than about 0.8. In a presently preferred embodiment of the invention, the fuel/air equivalence ratio of the mixture passing through the mixing chamber 92 is greater than about 3, the weight ratio of water to fuel passing through the mixing chamber 92 is less than about 0.6, and the fuel/air equivalence ratio of the mixture in the first section of the combustion chamber 34 is less than about 0.7. The reduced weight ratio of water to fuel reduces the detrimental effects of the water on the life of the combustion chamber, while still achieving benefits of lower combustion temperatures.

In order to simplify manufacture, the nozzle structure 70 is advantageously formed as three separate pieces 74, 76, and 78. Pieces 74 and 76 can be provided with mating holes 124 and 126, into which pin 128 can be inserted to maintain the alignment of pieces 74 and 76 during welding of these pieces together. Similarly, pieces 76 and 78 can be provided with mating holes 130 and 132 into which pin 134 can be inserted to maintain the alignment of pieces 76 and 78 during welding of these pieces together. However, any suitable method of manufacture of the nozzle structure 70 can be employed.

Reasonable variations and modifications are possible within the scope of the foregoing description, the drawings and the appended claims to the invention. While the invention has been illustrated in terms of an annular combustion chamber, the invention is also applicable to one or more combustion chambers of substantially cylindrical configuration. While the combustion chamber has been illustrated as having its centerline form a U, the invention is applicable to combustion chambers having centerlines which are straight or less curved than that of the illustrated combustion chamber.

I claim:

1. A method for operating a gas turbine engine, said method comprising:

passing fuel sequentially through an upstream section, a venturi section, and a downstream section of an elongated passageway through an elongated nozzle structure into a first section of a combustion chamber, said venturi section having a throat, said elongated nozzle structure having at least one air inlet passageway extending from said throat to an exterior surface of said nozzle structure;

providing air to said at least one air inlet passageway, whereby passage of fuel through said venturi section educts air through said at least one air inlet passageway into said venturi section so that the thus educted air mixes with the fuel passing through said venturi section; and further introducing water into said downstream section of the elongated passageway through the elongated nozzle structure for mixing with the mixture of fuel and air passing through said downstream section, whereby a mixture of fuel, air and water are simultaneously introduced into said combustion chamber.

2. A method in accordance with claim 1, further comprising the steps of:

passing the air/fuel/water mixture from an outlet port of said nozzle structure into a first section of said combustion chamber;

introducing combustion air into said first section of said combustion chamber through a plurality of first air inlet openings, said combustion air flowing into said first section of the combustion chamber in a direction counter to the flow of the air/fuel/water mixture from the outlet port of the nozzle structure, thereby providing a mixture of fresh air with the air/fuel/water mixture; and introducing additional combustion air through a plurality of second air inlet openings in a second section of said combustion chamber.

3. A method in accordance with claim 1, wherein the fuel/air equivalence ratio of the resulting mixture of fuel and air passing through the downstream section of the elongated passageway is substantially greater than 1.

4. A method in accordance with claim 3, wherein there is a resulting fuel/air equivalence ratio in the first section of the combustion chamber substantially less than 1.

5. A method in accordance with claim 4, wherein there is a weight ratio of water to fuel passing through said downstream section less than about 0.8.

6. A method in accordance with claim 5, wherein the fuel/air equivalence ratio of the mixture passing through said downstream section is greater than about 3, wherein the fuel/air equivalence ratio of the mixture in the first section of the combustion chamber is less than about 0.7, and wherein the weight ratio of water to fuel passing through said downstream section is less than about 0.8.

* * * * *